US005494472A

United States Patent [19]

Levy et al.

[11] Patent Number: 5,494,472

[45] Date of Patent: Feb. 27, 1996

[54] TOY FIGURES WITH RUPTURABLE MICROCAPSULES FOR SIMULATED BLEEDING

[76] Inventors: Richard C. Levy, P. O. Box 34828, Bethesda, Md. 20827; Richard J. Maddocks, 302 Lexington Dr., Silver Spring, Md. 20901

[21] Appl. No.: 386,631

[22] Filed: Feb. 10, 1995

[51] Int. Cl.[6] ..... A63H 3/00; A63H 3/52

[52] U.S. Cl. ..... 446/295; 446/267

[58] Field of Search ..... 472/51, 52, 57, 472/69, 70, 72; 428/321.5; 434/268, 269, 262; 446/295, 296, 267, 268, 385, 475, 491, 4, 5

[56] References Cited

U.S. PATENT DOCUMENTS

| | | | |
|---|---|---|---|
| D. 273,313 | 4/1984 | Callais, Jr. | 446/295 X |
| 2,729,024 | 1/1956 | Guttmann | 446/475 X |
| 3,576,660 | 4/1971 | Bayless et al. . | |
| 3,647,504 | 3/1972 | Hayes, Jr. et al. | 428/321.5 X |
| 3,858,351 | 1/1975 | Porter | 446/296 |
| 3,859,229 | 1/1975 | Brockett . | |
| 3,936,567 | 2/1976 | Vesely | 428/325 |
| 4,257,188 | 3/1981 | Barker | 446/395 X |
| 4,375,733 | 3/1983 | Callais, Jr. | 446/295 |
| 4,917,372 | 4/1990 | Zeitlin | 472/70 X |
| 4,986,429 | 1/1991 | Singleton, Jr. | 428/321.5 X |
| 5,000,486 | 3/1991 | Rua, Jr. et al. . | |
| 5,037,343 | 8/1991 | Benites . | |
| 5,312,680 | 5/1994 | Simpson | 428/321.5 |

*Primary Examiner*—Robert A. Hafer
*Assistant Examiner*—D. Neal Muir
*Attorney, Agent, or Firm*—Nixon & Vanderhye

[57] ABSTRACT

A toy figure has microcapsules affixed to its surface with the microcapsules containing a colored medium, such as a liquid or viscous substance. Upon rupture of the microcapsules, the colored medium is dispersed and is in contrast to the surrounding color to simulate "bleeding" of the toy figure. The microcapsules can be provided in a patch form such that, upon rupture of substantially all of the microcapsules in a particular patch, such patch can be replaced by a subsequent patch having unruptured microcapsules.

7 Claims, 1 Drawing Sheet

TOY FIGURES WITH RUPTURABLE MICROCAPSULES FOR SIMULATED BLEEDING

TECHNICAL FIELD

The present invention relates generally to toy figures, and particularly relates to toy figures enabling release of an encapsulated medium, such as a liquid or a viscous fluid in response to applied pressure for simulation purposes, e.g., to simulate "bleeding."

BACKGROUND AND DISCLOSURE OF THE INVENTION

In various environments, it is oftentimes desirable to have a visual indication of a change of appearance responsive to certain applied stimuli. For example, and in accordance with the present invention, it has been found desirable to release on demand a liquid or viscous fluid to simulate "bleeding" in toy figures such as toy animals, insects, dolls and anthropomorphic forms to demonstrate that the figures have been "injured," or in other toys such as cars or locomotives to indicate leakage. Typically, the toy figures of this invention are three-dimensional, but the invention is not limited thereto and is applicable also to two-dimensional toy figures.

The term "bleeding" is used herein in a broad sense to indicate a dispersal of a medium, for example, a liquid or a viscous substance where previously the medium was confined or encapsulated, and wherein the medium dispersed visually contrasts with portions of the toy figure or articles surrounding the dispersed medium. Typically, the medium dispersed will vary in characteristics, for example, color, in accordance with the theme of the toy figure. Thus, a toy doll may have a portion of its surface which, in response to externally applied stimuli, e.g., upon application of pressure to that surface portion of the doll, disperses a liquid colored red, simulating an injury to the doll. Thus, the doll "bleeds" from a simulated scratch or a cut. As another example, a toy figure, such as a soldier or knight, may disperse a viscous fluid colored red to simulate bleeding from a wound when pressure, such as being struck by a toy sword, is applied to the toy figure in accordance with this invention. Sores, abscesses and other types of open wounds may be simulated in toys. Other colors may be used to simulate "bleeding," for example, the color green may be used to simulate "bleeding" from a toy anthropomorphic form, such as a Martian spaceman.

The present invention is based on known microencapsulation techniques such as previously used for carbonless paper, as well as scratch and sniff applications on paper for releasing scent or fragrance. Typically, pressure-rupturable spherical capsules having very thin walls are formed of a gelatin and confine within their walls a liquid, e.g., an oil. The capsules are typically fixed on a substrate and pressure is conventionally applied to the capsules to rupture them and release the liquid. Techniques for forming the microcapsules with liquid therein are described and illustrated in U.S. Pats. Nos. 3,859,229 and 3,576,660, the disclosures of which are incorporated herein by reference. To applicants' knowledge, however, microencapsulation techniques have not been employed to simulate "bleeding" in connection with two and three-dimensional toy figures.

In a preferred embodiment according to the present invention, there is provided a toy figure comprising a three-dimensional toy figure body having an outer surface exhibiting a first discrete color, the toy figure body including a plurality of rupturable microcapsules each having a wall confining a medium within the microcapsule, the plurality of microcapsules being disposed over a predetermined discrete area of the toy figure body and forming a continuation of the outer surface, the walls of the microcapsules being rupturable in response to application of pressure to the microcapsules to disperse the medium over a discrete portion of the outer surface of the toy figure body, the medium being of a color contrasting with the discrete color of the outer surface of the toy figure body to simulate bleeding in the outer surface portion of the toy figure body.

In a further preferred embodiment according to the present invention, there is provided apparatus for dispersing a flowable medium in a simulation of "bleeding" from a body comprising a patch for releasable securement to the body having a substrate and a plurality of rupturable microcapsules on one side of the substrate, each microcapsule having a wall confining a flowable medium within the microcapsule, the substrate having a releasable adhesive along a side thereof opposite the microcapsules for releasably securing the patch to the body, the walls of the microcapsule being rupturable in response to application of pressure to the microcapsules to disperse the medium over a discrete portion of the surface of the body, the medium being of a color contrasting with a discrete color of the body to simulate bleeding in the surface of the body.

Accordingly, it is a primary object of the present invention to provide novel and improved two and three-dimensional toy figures capable of forming a visually perceptible contrasting coating, e.g., simulated bleeding, at a specified site on a toy figure or article upon application of pressure to that site.

BEST MODE FOR CARRYING OUT THE INVENTION

Figure 1:
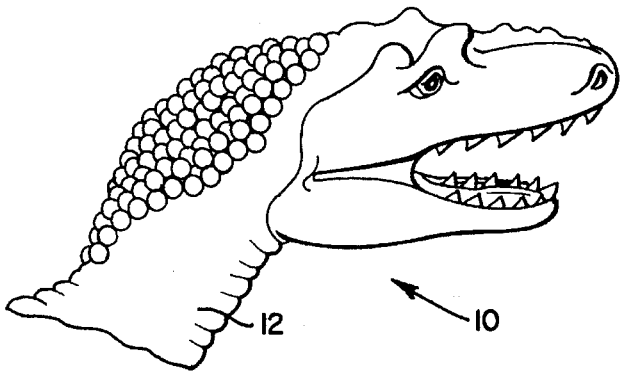
FIG. 1 is a fragmentary schematic representation of the head of a three-dimensional toy figure, for example, a dinosaur.

Referring now to the drawing figures, particularly to FIG. 1, there is illustrated a toy figure, generally designated 10, comprising a toy figure body 12, in this form, representative of a three-dimensional toy dinosaur's head. It will be appreciated that the present invention can be used with other toy figures, for example, toy animals, insects, dolls or anthropomorphic forms. By toy figure is meant a two or three-dimensional simulated human or anthropomorphic static or action form. By toy action figure or form is meant that the toy figure has one or more articulated members.

In a preferred form of the present invention, there is provided on the toy figure 10 a predetermined discrete area along the outer surface of the body 12 on which simulated bleeding is to be effected. For example, in the illustration of FIG. 1, the "bleeding" which in conjunction with the toy figure of the dinosaur will simulate actual bleeding occurs on the top and back side of the head of the toy dinosaur. Consequently, a discrete area of the toy figure is contrasted with areas thereof surrounding the discrete area such that an observer recognizes the contrast and, with appropriate coloration and/or other characteristics, such as viscosity, perceives the dispersed medium as actual blood emanating from a wound on the dinosaur.

Figure 2:
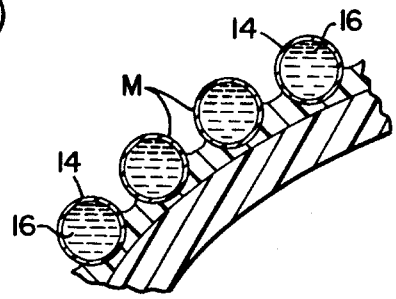
FIG. 2 is an enlarged fragmentary view of microcapsules applied to the back of the head of the toy figure illustrated in FIG. 1.
Figure 5:
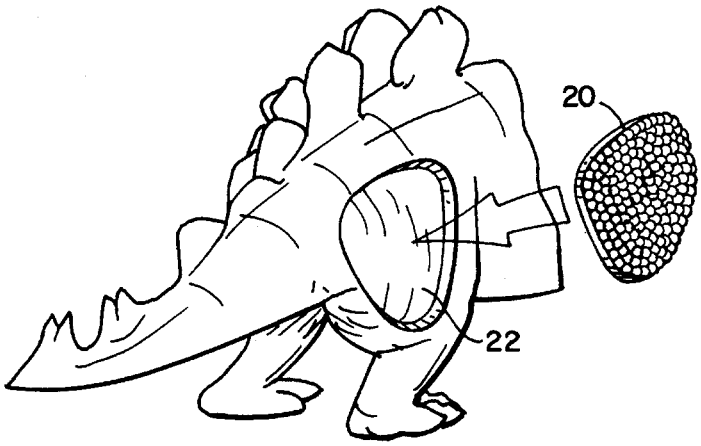
FIG. 5 is a fragmentary perspective view of a toy figure illustrating a further form of the application of the microcapsules to the toy figure.
Figure 6:
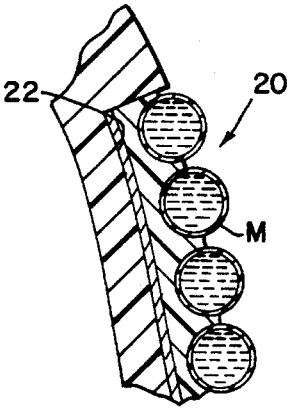
FIG. 6 is an enlarged fragmentary cross-sectional view of a patch of microcapsules applied to the toy figure illustrated in FIG. 5.

To accomplish the "bleeding," microencapsulation techniques are employed. Thus, microcapsules M, typically on the order of 800 to 2500 micron range, although other sizes can be provided, are formed and contain a core material, such as a colored liquid. For example, the microcapsules typically have an outer wall 14 as illustrated in FIG. 2 formed of a gelatin (Food Grade) material combined with carboxymethyl cellulose. The core flowable medium, e.g., a liquid or viscous fluid which would be dispersed upon rupturing the microcapsule wall 14, may comprise a mineral oil (Food Grade) containing a coloring element for example, Drug and Cosmetic Red #17 and Drug and Cosmetic Violet #2 to form a substantially red or violet colored medium, respectively, upon rupture of the capsule simulative of actual blood. Other types of drug and cosmetic pigments may be employed to provide different colors to the liquid when dispersed upon rupture of the microcapsules. The microcapsules M are fixed in a binder, for example, ethylene vinyl acetate, combined with a plasticizer such as glycerin. The binder may be coated onto the surface of the toy figure body, for example, by spraying, dipping or hand-coating the microcapsules and binder onto the body. Additionally, the microcapsules may be provided as a fixed body in sheet form, for example, as illustrated in FIG. 5 and 6. The side of the sheet opposite the microcapsules M may bear an adhesive, preferably a releasable adhesive, such as a pressure-sensitive adhesive, for securing the sheet or portions thereof to an underlying carrier.

Figure 3:
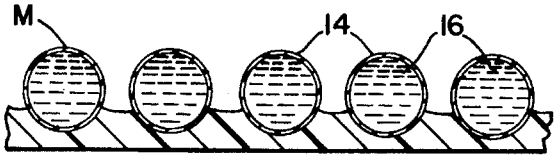
FIG. 3 is a fragmentary view of the microcapsules fixed in a substrate.
Figure 4:
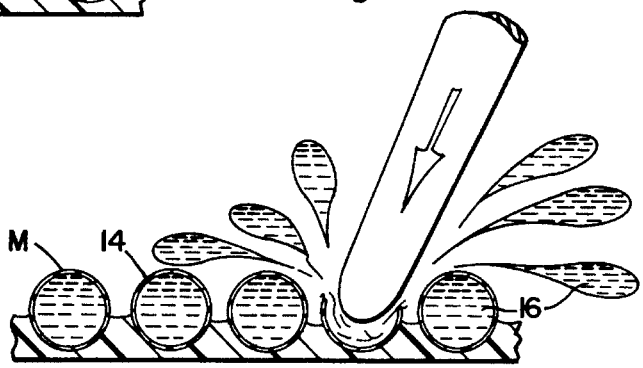
FIG. 4 is a schematic representation of the application of pressure to the microcapsules to release the contrasting medium confined therein.

Referring to FIGS. 3 and 4, it will be appreciated that the microcapsules M confine the core medium 16, including the coloring element, against dispersal in the absence of a rupture of the microcapsules. In FIG. 4, the microcapsules are illustrated schematically as rupturing and dispersing the medium, preferably a colored medium, onto an exposed surface area of the toy figure body. That is to say, by applying a pressure, e.g., striking the toy figure with a toy sword or a dart or the like or even the teeth of an attacking animal, to microcapsules located in the predetermined discrete area of the outer surface of the toy figure boby, the walls of the microcapsules are ruptured and the medium dye-containing core is dispersed over a portion of the outer surfaces of the body. That area portion is, of course, the area immediately adjacent the ruptured microcapsules.

In providing the microcapsules on a toy figure in accordance with the present invention, the outer surfaces of the microcapsules of the body are consistent with the characteristics of the surrounding area of the toy figure body such that the location of the microcapsules cannot otherwise be distinguished from the toy action figure itself prior to their rupture. When the microcapsules are applied to the toy figure, it is desirable to visually blend the microcapsules with the surrounding area such that the area containing the microcapsules is not distinguishable from the surrounding area prior to rupture of the microcapsules. To accomplish this, the capsules can be over-painted with a conventional paint that has a color or effect that blends with the surrounding surface area of the toy figure. Alternatively, the walls 14 of the microcapsules can be formed with a colored pigment, i.e., a colored gelatin, that blends with the surrounding surface of the toy so as to render the area of the toy figure containing the microcapsules prior to rupture indistinguishable from the remaining surface area of the toy figure. As a consequence, when the microcapsules are ruptured and the medium, e.g., colored dye-containing mineral oil, is dispersed, the contrasting colors of the dye of the core oil and the color of the surrounding area of the body provide a visual effect simulating bleeding by the toy figure body. For example, if the toy figure illustrated in FIG. 1, i.e., the dinosaur, is provided in a green color, the coro medium in the microcapsules can be provided with a substantially red-colored dye. Thus, when the microcapsules are ruptured, the medium containing the red-colored dye would lie in sharp contrast to the typical green outer body color of the dinosaur and simulate an injury to the dinosaur bleeding in that discrete area.

In FIGS. 5 and 6, the microcapsules are provided in a series of patches. For example, the microcapsules can be provided in sheet form with the binder formed of ethylene vinyl acetate with a plasticizer, such as glycerin, maintaining the microcapsules fixed on the sheet. The sheet can then be cut or precut to the appropriate size for fixing the cut patch 20 into a designated area 22 of the toy body. The designated area may be inset from the toy body such that when the patch is applied, the outer surface area of the microcapsules will lie substantially flush with the surrounding outer surface of the toy body. To secure the patch to the area 22, a pressure-sensitive adhesive with silicone release paper may be provided on the side of the patch opposite the microcapsules. By removing the release paper, the patch can be adhered to and removed from the toy body. In this manner, the microcapsules of a patch can be ruptured as previously described to simulate "bleeding." When substantially the entirety of the microcapsules are ruptured, the patch can be removed from the area 22 and a new patch releasably secured in its place containing yet-unruptured microcapsules whereby the patches may be employed successively on the toy figure body to simulate "bleeding." The patches may be precut or provided in large sheets for cutting into individual patches.

The patches previously described may also be applied, not only to toy figures, but also to humans to simulate "bleeding." Thus, the patch with a releasable adhesive may be applied to an individual's face, arm or other body part. When pressure is applied, the microcapsules will rupture to simulate "bleeding," e.g., simulate actual blood, viscous fluid from sores or abscesses and the like.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A toy figure comprising:

a two or three-dimensional toy figure body having an outer surface exhibiting a first discrete color;

said toy figure body including a plurality of rupturable microcapsules each having a wall confining a flowable medium within the microcapsule, said plurality of microcapsules being disposed over a predetermined discrete area of said toy figure body and forming a continuation of said outer surface;

the walls of said microcapsules being rupturable in response to application of pressure to the microcapsules to disperse said medium over a discrete portion of the outer surface of the toy figure body;

said medium being of a color contrasting with said discrete color of said outer surface of said toy figure body to simulate bleeding in said outer surface portion of the toy figure body.

2. A toy figure according to claim 1 wherein said microcapsules have visually perceptible characteristics along outer faces thereof consistent with the toy figure body such that the outer faces of the microcapsules are indistinguishable from the outer surface of said toy figure body prior to application of pressure to the microcapsules.

3. A toy figure according to claim 1 wherein the microcapsule walls have a color corresponding to the first discrete color of the outer surface of the toy figure body to render said microcapsules indistinguishable in color from said outer surface of said toy figure body prior to application of pressure to the microcapsules.

4. A toy figure according to claim 1 wherein said microcapsules have a surface coating colored to correspond substantially to the first discrete color of the outer surface of the toy figure body to render said discrete area substantially indistinguishable in color from said outer surface of said toy figure body.

5. A toy figure according to claim 1 wherein the microcapsules are fixed to one another by a binder.

6. A toy figure according to claim 1 wherein the microcapsules are fixed to a substrate, a plurality of substrates with microcapsules fixed thereto forming a plurality of discrete patches for selective securement to said predetermined discrete area of said outer toy figure body whereby patches secured to said outer surface of said toy figure body with microcapsules ruptured can be replaced by patches having intact microcapsules available for rupture.

7. A toy figure according to claim 6 wherein said substrate has a releasable adhesive along a side thereof opposite said microcapsules for releasably securing said patches to said toy figure body.

* * * * *